US006843010B2

(12) United States Patent
Robinson et al.

(10) Patent No.: US 6,843,010 B2
(45) Date of Patent: Jan. 18, 2005

(54) SIGN WITH PHOTO-LUMINESCENT AND CURRENT-GENERATED LIGHTING

(76) Inventors: Michael G. Robinson, 3860 Orange Blossom La., Columbus, OH (US) 43230; Thomas W. Brignall, Jr., 14765 Elm Dr., Marcellus, MI (US) 49067

( * ) Notice: Subject to any disclaimer, the term of this patent is extended or adjusted under 35 U.S.C. 154(b) by 0 days.

(21) Appl. No.: 10/361,259

(22) Filed: Feb. 10, 2003

(65) Prior Publication Data

US 2004/0154199 A1 Aug. 12, 2004

(51) Int. Cl.[7] ..... G09F 13/00
(52) U.S. Cl. ..... 40/571; 40/542; 40/581
(58) Field of Search ..... 40/546, 541, 547, 40/549, 581, 582, 542, 544, 563, 571, 583

(56) References Cited

U.S. PATENT DOCUMENTS 2,551,622 A * 5/1951 Mohr ..... 40/546
3,197,902 A * 8/1965 Buzan ..... 40/546
3,241,256 A * 3/1966 Viret et al. ..... 40/546
3,372,504 A * 3/1968 Hardesty ..... 40/546
4,768,300 A * 9/1988 Rutili ..... 40/546
6,305,109 B1 * 10/2001 Lee ..... 40/546

* cited by examiner

*Primary Examiner*—Mark T. Le
(74) *Attorney, Agent, or Firm*—William Rambo

(57) ABSTRACT

A light-conductive and transparent front panel 12 is mounted in a frame 11. One or more etched characters 22 are formed on a rear surface 17 of the front panel 12, and one or more photo-luminescent characters 16 is/are disposed in overlying relation to the etched character(s) 22. A strip of light emitting diodes (LED's) 14 are mounted in the frame 11 adjacent to a side wall 13 of the front panel 12. Mounting members 19, 20 are formed on the frame to position and hold the front panel in place.

15 Claims, 3 Drawing Sheets

SIGN WITH PHOTO-LUMINESCENT AND CURRENT-GENERATED LIGHTING

BACKGROUND OF THE INVENTION

The present invention relates to signs and more particularly to signs or guidance markings which indicate an exit or path of egress from a public building or conveyance (generally, an "exit sign").

Building codes, transportation safety codes, and other regulations require exit signs to be very easy to see. Typically, five foot-candles of light are required on the face of an exit sign all the time a building is occupied. To meet this requirement, battery backup systems have been employed to keep signs illuminated during power failures. However, battery backup systems have several limitations. They require periodic bulb/tube replacement, battery replacement and testing. They consume power all of the time. The battery charger and other electrical components are subject to failure and replacement. The inoperability of the battery backup system is likely to go unnoticed until a scheduled test date or a power failure. In the latter case, lives may be endangered.

The present inventors also believe there is a need for relatively compact exit signs designed to be mounted close to the floors of buildings and conveyances so that people moving below a layer of smoke can find their way out. Thin profile signs are particularly well suited for this purpose because they are less likely to impede traffic or to cause or sustain damage than exit signs designed to be installed above a door frame, where the sign's depth was relatively immaterial.

Improvements in photo-luminescent materials have led to signs that are bright enough to stand alone and pass Underwriters Laboratories® requirements. U.S. Pat. No. 6,364,498 discloses a sign that uses a powered light source to illuminate the lettering or other characters and to energize photo-luminescent pigment during normal operation. The pigment glows and thereby illuminates the lettering in the event of a power failure. It is believed that the drawbacks to this prior art photo-luminescent sign were its relative bulkiness and relatively substantial energy and maintenance requirements.

Thus the present inventors were faced with the problems of developing an exit sign that (1) does not need a secondary or emergency source of electricity to meet illumination requirements; (2) requires less electrical power and maintenance than prior art exit signs; and (3) can be produced with a thin profile to meet floor or low wall mounting requirements.

SUMMARY OF THE INVENTION

The present invention is an exit sign comprising a frame; a light-conductive and transparent first panel mountable in the frame and having at least one side wall; an electrically actuated light mountable in the frame adjacent to said at least one side wall of the first panel; at least one photo-luminescent character positionable on a rear surface of the first panel; and at least one mounting member for mounting the first panel in the frame.

Preferably, the present exit sign is also provided with a second panel upon which the photo-luminescent character or characters is/are mounted, an electrical conductor connected to the light and extending outwardly of the frame; a back panel; and at least one mounting member for removably mounting the back panel on the frame.

DETAILED DESCRIPTION OF THE PREFERRED EMBODIMENT

Figure 1:
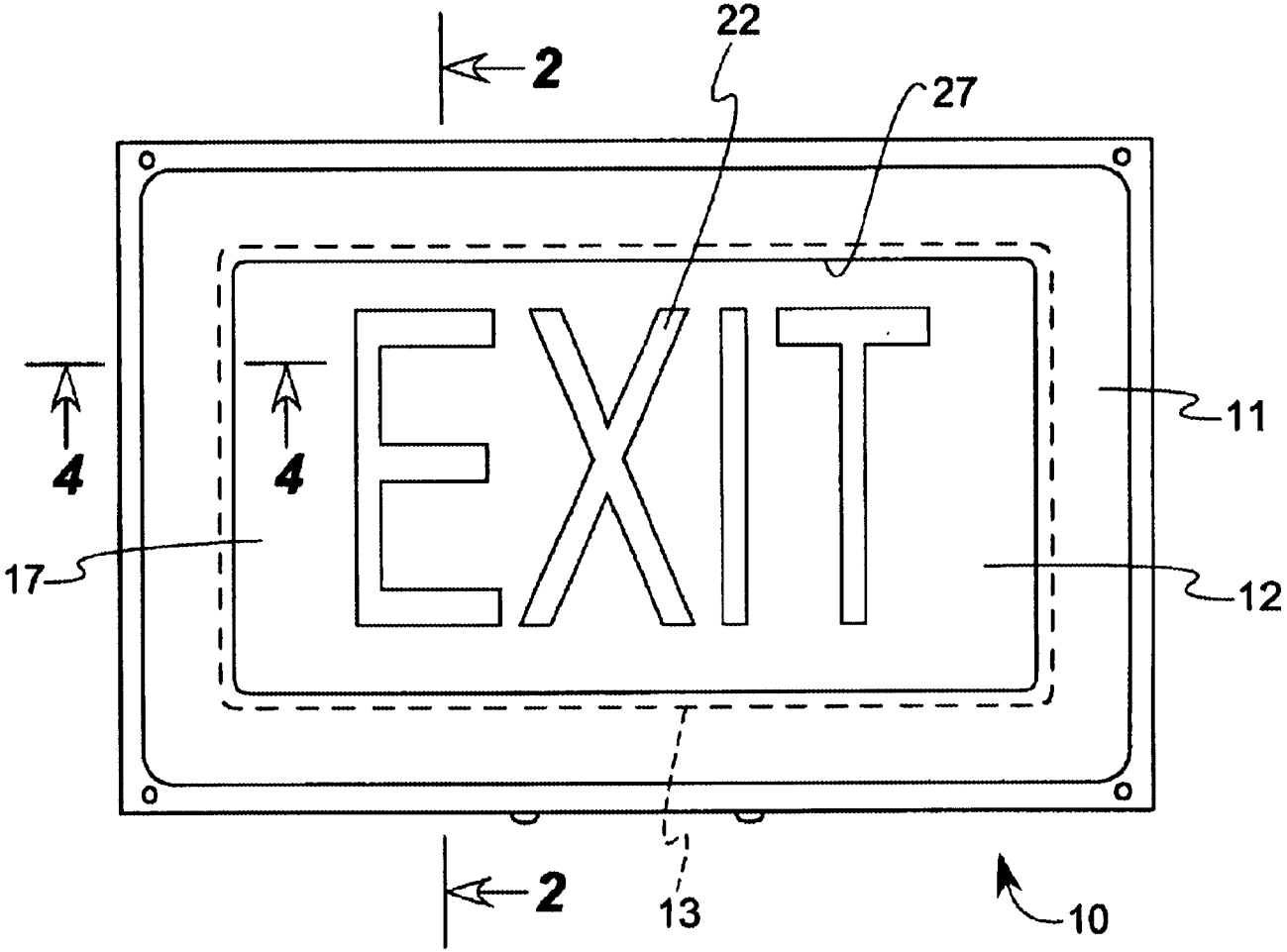
FIG. 1 is a front elevational view of an exit sign according to the present invention.

As illustrated in FIGS. 1–5, an exit sign according to the present invention, generally designated 10, basically comprises a frame 11; a light-conductive and transparent first panel 12 mountable in the frame and having at least one side wall 13; an electrically actuated light 14 mountable in the frame 11 adjacent to said at least one side wall 13 of the first panel 12; at least one photo-luminescent character 16 positionable on a rear surface 17 of the first panel 12; and at least one mounting member 19 for mounting the first panel 12 in the frame 11.

Figure 3:
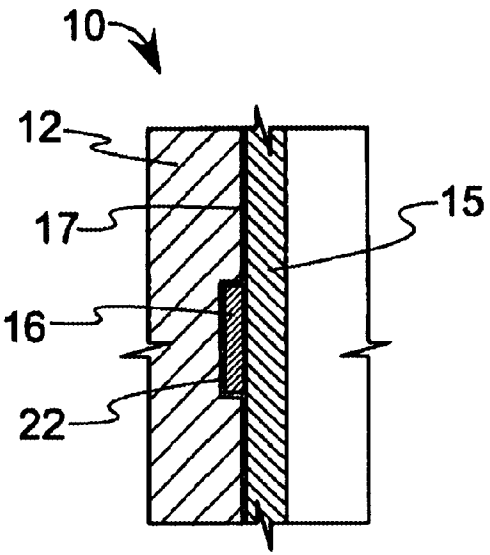
FIG. 3 is an enlarged detail view taken from FIG. 1 and particularly illustrates one of the photo-luminescent letters of the present exit sign underlying a corresponding etched portion of a light-conducting front panel.
Figure 5:
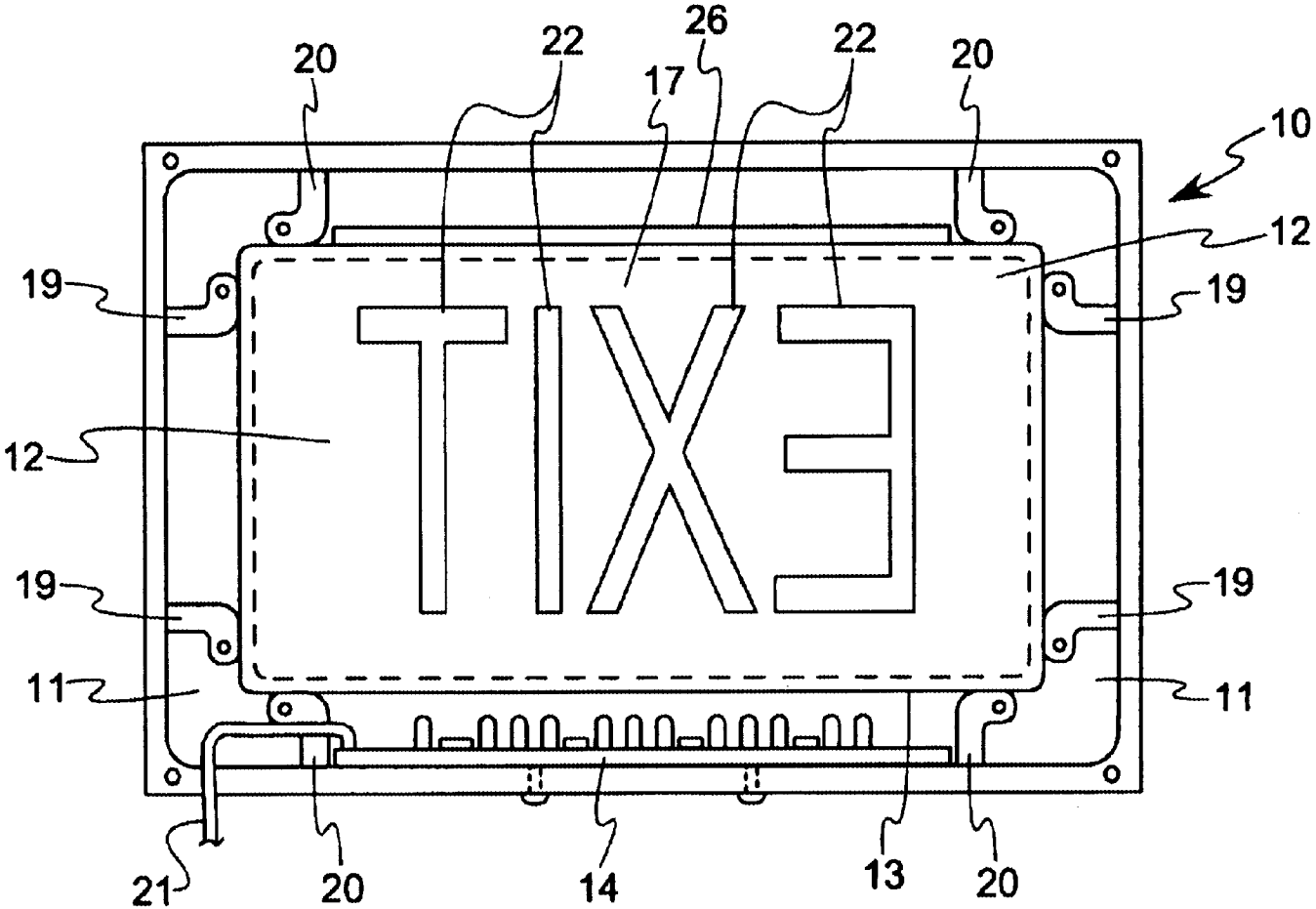
FIG. 5 is a rear elevational view of the present exit sign and particularly illustrates the interior of the frame, the front light-conducting panel and an array of LED's in a preferred form of the present exit sign.

As illustrated in FIGS. 3 and 5, the rear surface 17 of the light-conducting and transparent first or front panel 12 is preferably provided with one or more etched characters 22 which are mirror images of the photo-luminescent character (s) 16. Accordingly, the front panel 12 is advantageously formed from acrylic, polycarbonate, polymer, glass or other suitable transparent material that can be etched and that is of generally uniform thickness within a range of 6.35 to 19.05 millimeters (0.25 to 0.75 inches), and more preferably within a range of 9.53 to 12.70 millimeters (0.375 to 0.500 inches). The etched characters 22 are illuminated by the light 14, which illumination is reflected forwardly through the transparent front panel 12 to provide guidance to those to whom the present exit sign is visible and rearwardly to energize the photo-luminescent characters 16.

Figure 4:
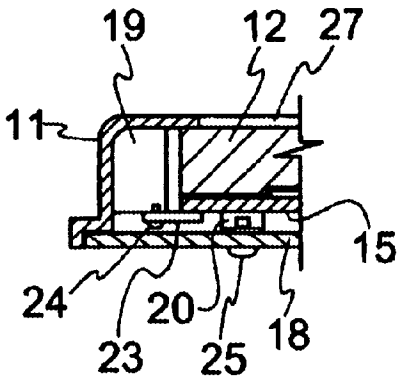
FIG. 4 is a fragmentary horizontal sectional view of the present exit sign taken along line 4—4 of FIG. 1.
Figure 2:
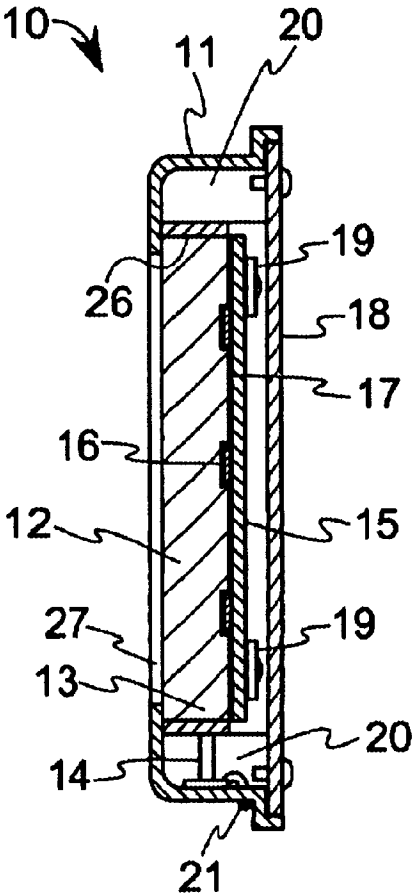
FIG. 2 is a vertical sectional view of the present exit sign taken along line 2—2 of FIG. 1.

As illustrated in FIGS. 2–4, the present exit sign 10 is preferably provided with a second panel 15 upon which the photo-luminescent character(s) 16 is/are mounted and wherein the second panel 15 is mountable in the frame 11 with the photo-luminescent character(s) 16 disposed adjacent to the rear surface 17 of the first panel 12. The etched characters 22 are positioned on the back surface 17 of the front panel 12 to be aligned with the photo-luminescent characters 16 when the front 12 and intermediate 15 panels are mounted in the frame 11.

Alternatively, a resin from which the photo-luminescent character(s) 16 is formed in conventional fashion may be applied directly (not shown) to the etched character(s) on the rear surface 17 of the first panel 12. In the absence of an intermediate panel 15, a white or other reflective coating (not shown) might be applied to a back surface of the photo-luminescent character(s) 16 once it/they have formed on the etched character(s) 22, and a green or red tint (not shown) might be applied to the rear surface 17 of the transparent panel 12.

As illustrated in FIGS. 2–5, the present exit sign 10 is also preferably provided with an electrical conductor 21 connected to the light 14 and extending outwardly of the frame 11, a back panel 18 and at least one mounting member 20 for removably mounting the back panel 18 on the frame 11.

FIGS. 2, 4 and 5 particularly illustrate the preferred manner in which the frame 11 is constructed and in which the panels 12, 15 and 18 are removably secured to the frame 11. The present frame 11 is molded from a flame retarding (class I) polymeric material such as, but not limited to, polycarbonate, ABS, or acrylic and has a depth within a range of 12.7 to 38.1 millimeters (0.5 to 1.5 inches), and more preferably within a range of 12.7 to 15.8 millimeters (0.5 to 0.625 inches). The frame may also be fabricated of metal, wood or stone for special applications, or molded to look like these materials. The frame 11 and the front 12, intermediate 15 and rear 18 panels are rectangular in shape, and the front 12 and intermediate 15 panels are substantially the same width and height. The mounting members 19, 20 are integrally molded in the frame 11.

As illustrated in FIGS. 1, 2 and 5, the frame 11 defines an opening 27 through which the etched characters 22 may be seen. The front panel 12 and the intermediate panel 15 are preferably wider and longer than the frame opening 22 so that overlapping portions of the front panel 12 are seated on the frame 11.

As illustrated in FIG. 4, the mounting members 19 which secure the front 12 and intermediate 15 panels are preferably shorter than the mounting members 20 which secure the rear panel 18. In this manner, a space is provided between the intermediate 15 and rear 18 panels when they are secured to the frame 11.

As further illustrated in FIG. 4, a locking plate 23 may be removably secured by a fastener 24 to each of the mounting members 19 and may extend over an edge portion of the intermediate panel 15 to hold the front 12 and intermediate 15 panels in place. The rear panel 18 may be removably secured directly to the mounting members 20 by fasteners 25 extending through the panel 18 and into the mounting members 20.

As illustrated in FIG. 5, the mounting members 19 are preferably disposed in spaced apart pairs on opposite short sides of the frame, and the mounting members 20 are disposed in spaced apart pairs on opposite long sides of the frame. Advantageously, the distance between the mounting members 19 on the opposite short sides of the frame 11 is only slightly greater than the width of the front 12 and intermediate 15 panels, and the distance between the mounting members 20 on the opposite long sides of the frame 11 is only slightly greater that the height of the front 12 and intermediate 15 panels. In this manner, the mounting members 19, 20 prevent the front 12 and intermediate 15 panels from shifting out from under the locking plates 24. The mounting members 19, 20 may be formed advantageously with groves for guiding the electrical conductor 21 along the frame 11, with holes for receiving mechanical fasteners 24, 25 and/or notches for holding the light 14 or a reflective element 26 in place in the frame 11.

As illustrated in FIG. 5, the electrically actuated light 14 is preferably a strip of light emitting diodes (LED's) mounted along one of the long sides of the frame 11 between the pair of mounting members 20 and in close proximity to an adjacent long edge 13 of the front light-conducting panel 12. A transformer (not shown) may be used to supply the proper voltage to the LED's 14.

As illustrated in FIG. 2, the LED's are preferably aligned with the light-conducting panel 12. In addition, a mirror or other reflective element 26 may be mounted along an edge or side of the light conductive panel 12 opposite to the LED side 13, and/or the LED strip or board may have a mirrored or reflective surface in between the LED lamps. It is believed that the amount of light which the front panel 12 carries or conducts from the LED's 14 to the etched characters 22 and, hence, to energize the photo-luminescent characters 16 is enhanced in the foregoing manner. Advantageously, the LED lamps may be tinted in such a manner that the light transmitted outwardly from the etched characters 22 meets code requirements for exit signs of a specified color. For example, the LED's may be high output super red with an 18° or greater viewing angle, emitting light in the 660 nm. range; high output super green with an 18° or greater viewing angle, emitting light in the 525 nm. Range; or high output super White with a 15° or greater viewing angle emitting light in the 6000 range of the Kelvin scale.

Preferably, the photo-luminescent characters 16 on the intermediate panel 15 are composed of rare earth pigments such as Strontium aluminate, zinc sulfide, or other suitable high performance photo luminescent material. It is desirable for the characters 16 to emit light with a luminance value of more than 400 millicandelas per square meter (mcd/$m^2$) after ten minutes when charged with a Xenon light source supplying 1000 Lux for thirty (30) minutes. Preferably, the photo-luminescent characters 16 meet or exceed the requirements of Underwriters' Laboratories® Standards No. 924 and No. 925. For example, a photo-luminescent exit sign manufactured by EverGlow GmbH of Wuppertal Germany (www.everglow.de) under German Patent No.196 00 340 may be employed as the intermediate panel 15 of the present invention. Advantageously, the photo luminescent material may be tinted to meet code requirements for exit signs of a specified color. The photo-luminescent characters 16 are illuminated and charged by the LED's 14 via the etched characters 22. Charging times range from 20 to 60 minutes to reach a 450 mcd/$m^2$ output when white LED's are used on the preferred from of the present invention. The charging time for green LED's ranges from 40 to 90 minutes, and the charging time for red LED's ranges from 60 to 120 minutes. These times are reduced when the present exit sign is used in an area where there is a substantial amount of ambient light such as in an office. In the event of an electrical failure, the characters 16 preferably provide sufficient luminosity to meet or exceed UL® 924-5 standards. The light output from the characters 16 when the LED's 14 are operational preferably meets or exceeds the foregoing luminosity range.

The foregoing description and drawings of the preferred embodiment are not intended to restrict the spirit of the present invention or to limit the scope of the following claims.

What is claimed is:

1. An exit sign comprising a light-conductive and transparent first panel having opposing side walls, said first panel being provided on a rear surface thereof with an etched mirror image of at least one character; a second panel having at least one photo-luminescent character disposed on a front surface thereof, said at least one photo-luminescent character corresponding in shape and size to the etched mirror image thereof on the first panel; a frame provided with a set of mounting members, said first and second panels being mounted in said frame with said at least one photo-luminescent character on the second panel aligned with the etched mirror image thereof on the first panel; and an electrically actuated light mounted on the frame adjacent to one of said opposing side walls of the first panel.

2. The exit sign according to claim 1, wherein the first panel is formed from one of a set comprising acrylate, polycarbonate, polymer, and glass.

3. The exit sign according to claim 1, wherein the first panel is of a thickness within a range of 6.35 to 19.05 millimeters.

4. The exit sign according to claim 1, wherein the first panel is of a thickness within a range of 9.53 to 12.70 millimeters.

5. The exit sign according to claim 1, wherein the sign is of a depth within a range of 12.7 to 38.1 millimeters.

6. The exit sign according to claim 1, wherein the sign is of a depth within a range of 12.7 to 15.8 millimeters.

7. The exit sign according to claim 1, wherein a reflective element is disposed adjacent to another of the opposing side walls of the first panel.

8. The exit sign according to claim 1, wherein the electrically actuated light comprises a plurality of light emitting diodes.

9. The exit sign according to claim 8, wherein the plurality of light emitting diodes are aligned with said one of the opposing side walls the first panel.

10. The exit sign according to claim 8, wherein the plurality of light emitting diodes emit a color within a set comprising white, green and red.

11. The exit sign according to claim 1, wherein said exit sign is further provided with a generally planar back panel, and wherein at least two of said set of mounting members are disposed on the frame to engage said planar back panel.

12. The exit sign according to claim 1, wherein the frame is integrally and unitarily molded from synthetic resin.

13. The exit sign according to claim 12, wherein the frame has an external surface and an internal surface and wherein the set of mounting members are disposed on the internal surface.

14. The exit sign according to claim 13 wherein the set of mounting members are disposed in the frame to engage the opposing side walls of the first panel.

15. The exit sign according to claim 1, wherein said at least one photo-luminescent character on the second panel is illuminated and charged by the electrically actuated light via said etched mirror image thereof on the first panel.

* * * * *